US011535352B2

(12) United States Patent
Hinz

(10) Patent No.: US 11,535,352 B2
(45) Date of Patent: Dec. 27, 2022

(54) TETHERED FLOATATION DEVICE AND RETRIEVAL SYSTEM

(71) Applicant: Jerry Hinz, South Bend, IN (US)

(72) Inventor: Jerry Hinz, South Bend, IN (US)

( * ) Notice: Subject to any disclaimer, the term of this patent is extended or adjusted under 35 U.S.C. 154(b) by 262 days.

(21) Appl. No.: 17/027,339

(22) Filed: Sep. 21, 2020

(65) Prior Publication Data

US 2021/0086880 A1 Mar. 25, 2021

Related U.S. Application Data

(60) Provisional application No. 62/903,212, filed on Sep. 20, 2019.

(51) Int. Cl.
*B63C 9/26* (2006.01)
*B66D 1/04* (2006.01)
*B66D 5/34* (2006.01)

(52) U.S. Cl.
CPC ..... *B63C 9/26* (2013.01); *B66D 1/04* (2013.01); *B66D 5/34* (2013.01)

(58) Field of Classification Search
CPC .. B63C 9/00; B63C 9/29; B63C 9/082; B66D 1/04; B66D 5/34
USPC ..... 441/80, 81, 84, 87
See application file for complete search history.

(56) References Cited

U.S. PATENT DOCUMENTS 4,343,056 A * 8/1982 McDonald ..... B63C 9/26 441/84
4,599,073 A * 7/1986 Fryer ..... B63C 9/26 441/84
5,192,238 A * 3/1993 Brown ..... B63C 9/00 441/84
6,599,626 B1 * 7/2003 Cogen ..... H01B 3/441 428/920

* cited by examiner

*Primary Examiner* — Daniel V Venne
(74) *Attorney, Agent, or Firm* — Botkin & Hall, LLP

(57) ABSTRACT

A device for retrieving a stranded or drowning person can attach to a boat cleat and be used to draw the stranded person towards the boat. The device has a floatation portion that is thrown to the stranded person. The floatation portion has multiple latches for different sized persons. A winch portion pivots about a cleat adaptor, which attaches to the horns of a boat cleat using an aperture and a locking pin. The winch portion receives the cord that is attached to the floatation portion. An optional ice foot mates to the cleat adapter for retrieving a person who has fallen through ice.

17 Claims, 7 Drawing Sheets

36
76
62
30
32
56
46
52
40
44
24
28
26
54
34
50
12

FIG.5
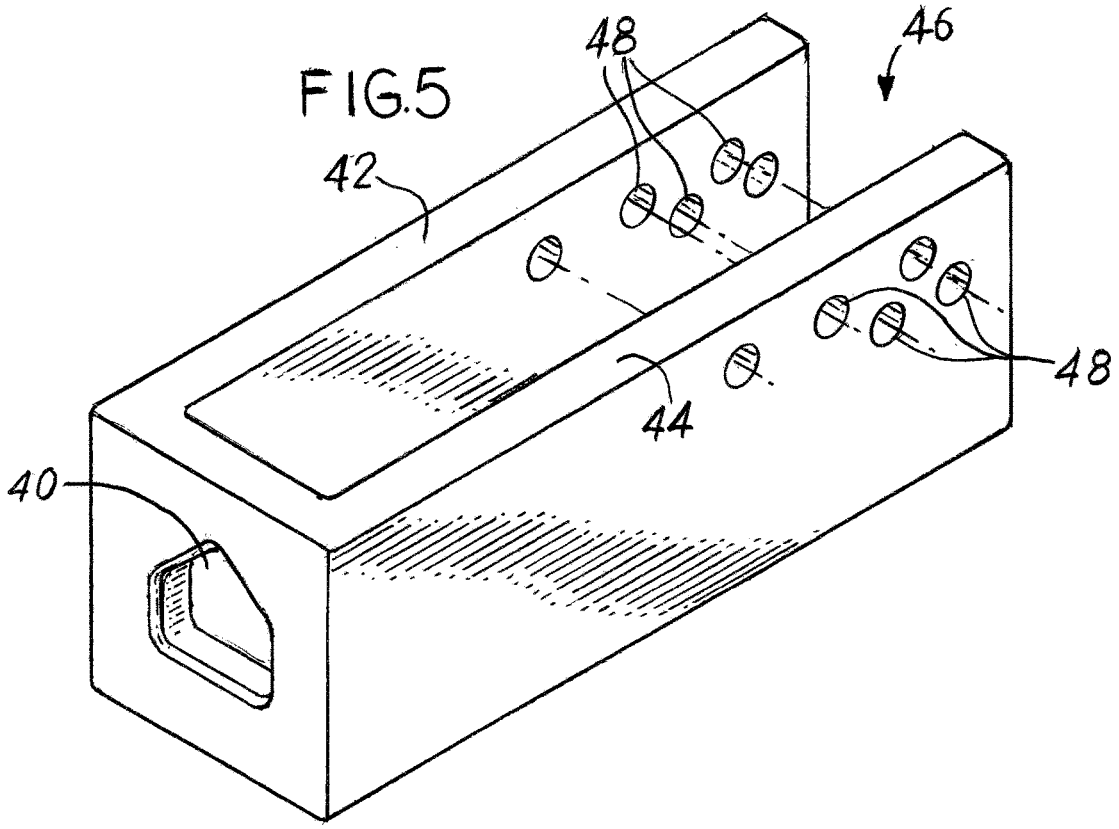
FIG.6
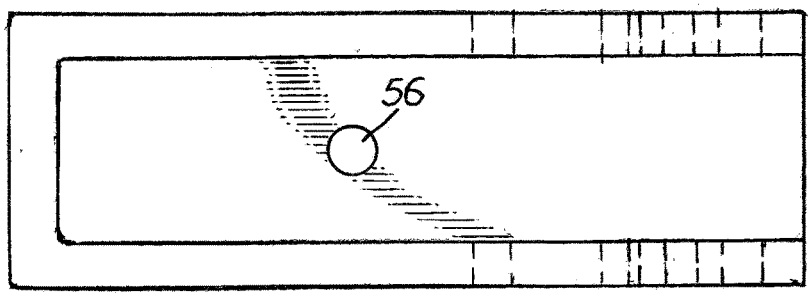
FIG. 7
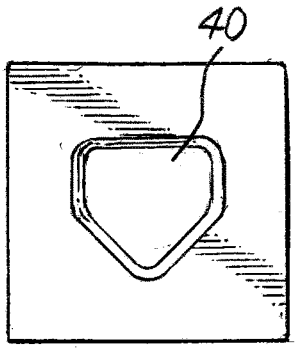
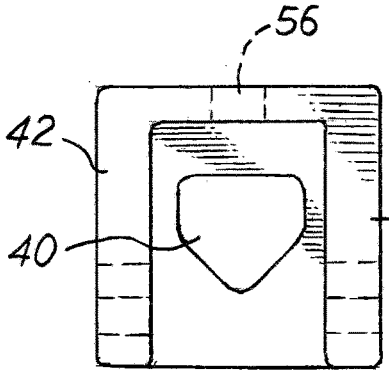
FIG.8

TETHERED FLOATATION DEVICE AND RETRIEVAL SYSTEM

CROSS REFERENCE TO RELATED APPLICATIONS

This application claims the benefit of U.S. Provisional Application Ser. No. 62/903,212, filed Sep. 20, 2019, the disclosures of which are hereby incorporated by reference.

BACKGROUND OF THE INVENTION

This present disclosure relates to retrieval of a person who has fallen into a body of water or needs assistance. Many attempts to solve this problem have been tackled with varying levels of success. The most memorable and common device is a ring buoy, commonly called a lifesaver. These are usually tied to a rope that can be used to retrieve the person that is in trouble. One large flaw with this type of device is the inability to accommodate for different sized or differently-abled individuals. It also requires person to hold on affirmatively, which can be difficult or impossible if the person is incapacitated. The rescuing person is required to have substantial upper body strength to pull a rope, especially to bring an incapacitated individual on to a boat or other vessel. An improved device is needed.

SUMMARY OF THE INVENTION

The present disclosure describes a flotation and retrieval device for an incapacitated or partially incapacitated person who has fallen into a body of water. The device includes a ratcheting winch portion that can affix to a boat cleat and a buoyant tether portion that can retrieve an individual. The device is adaptable for different sized individuals, such as children. By using the ice cleat adapter, the device can be used to retrieve an individual who has fallen through thin ice. The retrieval system works by connecting the rope or cord to a floatation device, tossing or otherwise getting the floatation device to the stranded person, so they can attach it to themselves. In the event the person is incapacitated, a person in the water secures the floatation device and latches it around them. The cord is then connected to the ratcheting mechanism and the user begins to draw the person towards the boat. The lever action of the ratcheting mechanism allows the user to move the handle back and forth without worry that it will interfere with nearby devices or portions of the boat. Other attachments can be used with the device, such as an ice cleat for retrieving someone who has fallen through the ice.

BRIEF DESCRIPTION OF THE DRAWINGS

FIG. 5 is an isometric view of the cleat adaptor;

FIG. 6 is a top view of the cleat adaptor;

FIG. 7 is a left side view of the cleat adaptor;

FIG. 8 is a right side view of the cleat adaptor;

DESCRIPTION OF THE PREFERRED EMBODIMENT

Figure 1:
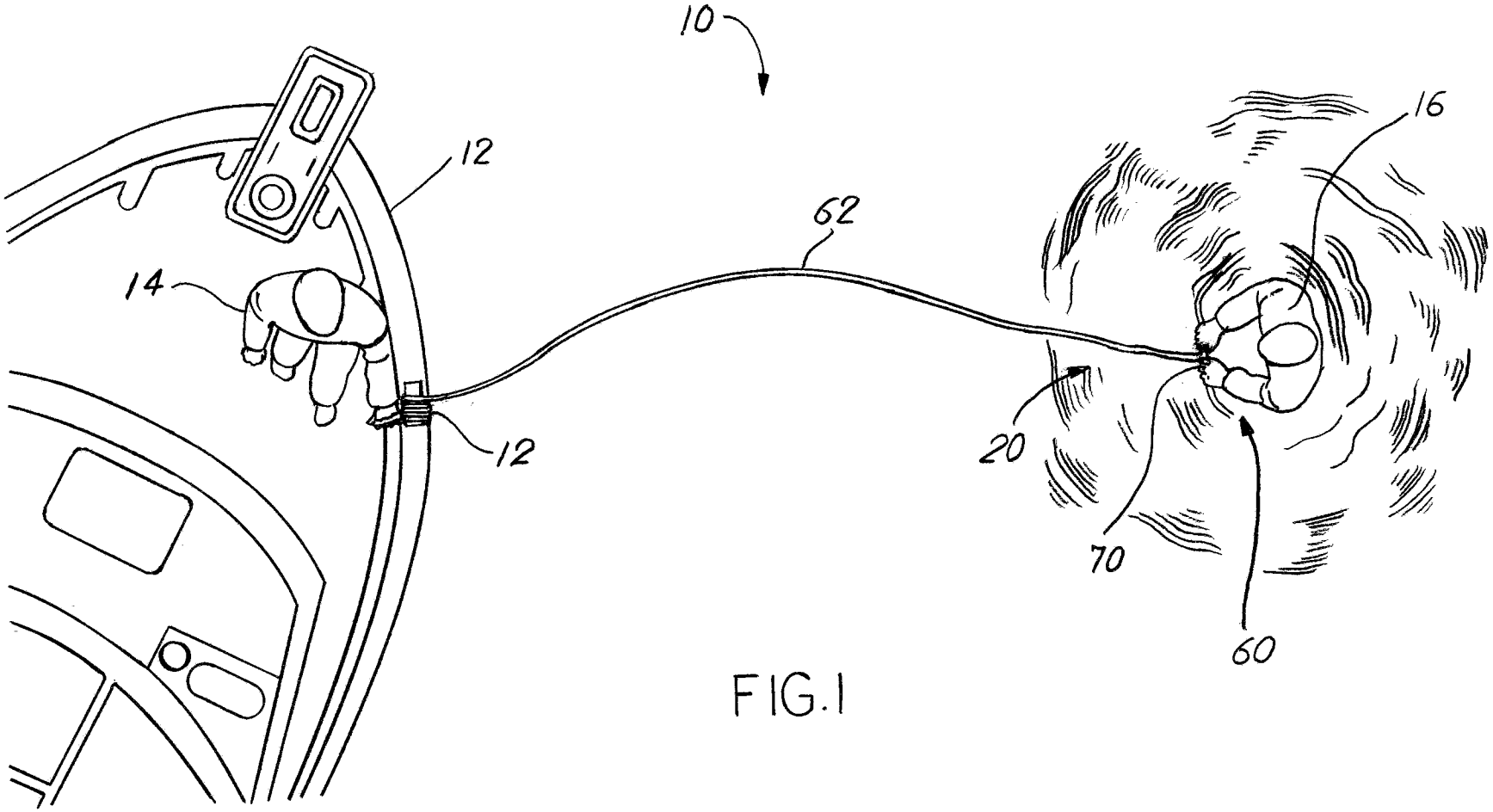
FIG. 1 is a top overview of the system in use on a boat.
Figure 2:
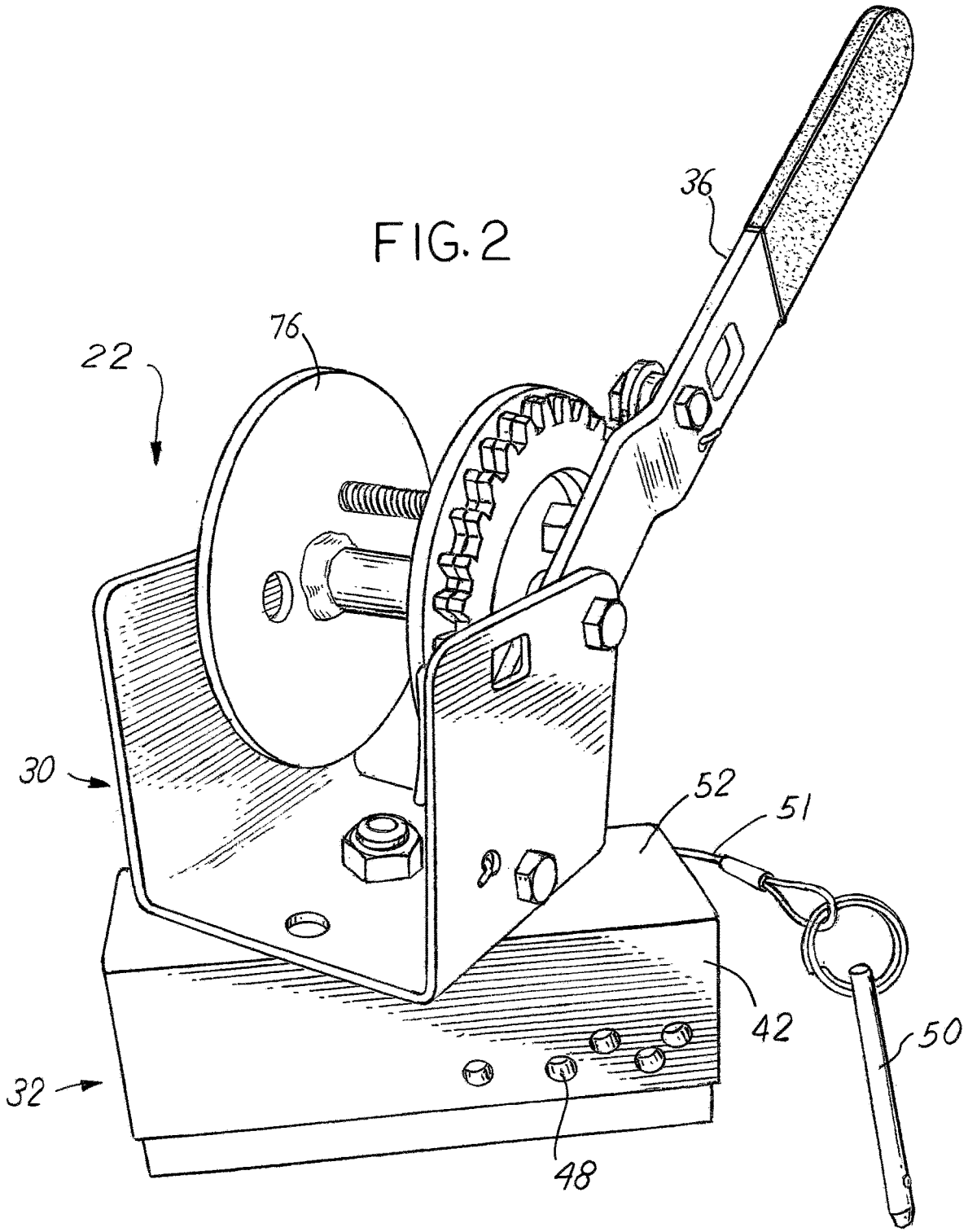
FIG. 2 is a perspective view of the winch and cleat adaptor.
Figure 3:
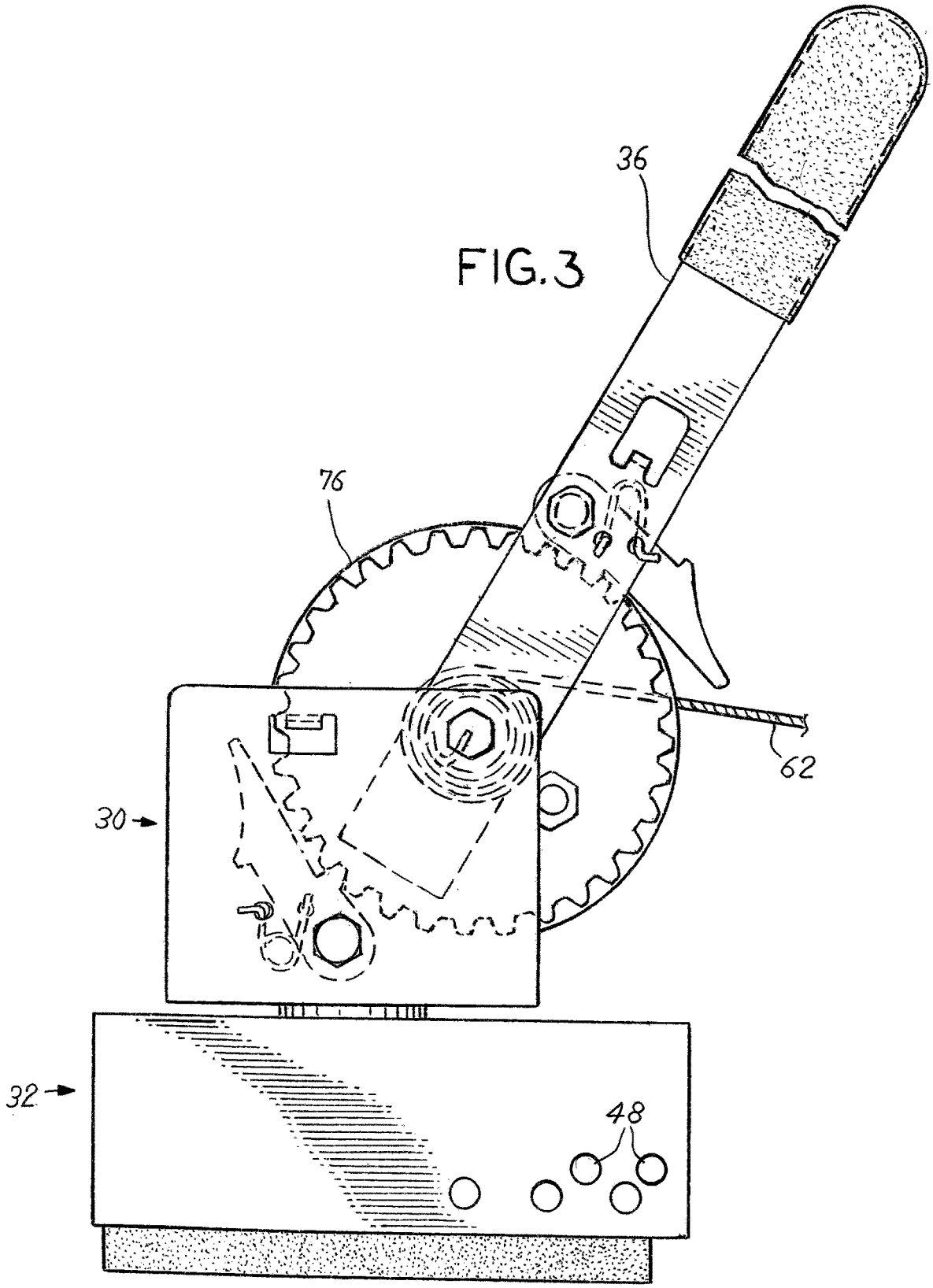
FIG. 3 is a side view of the winch and cleat adaptor.
Figure 4:
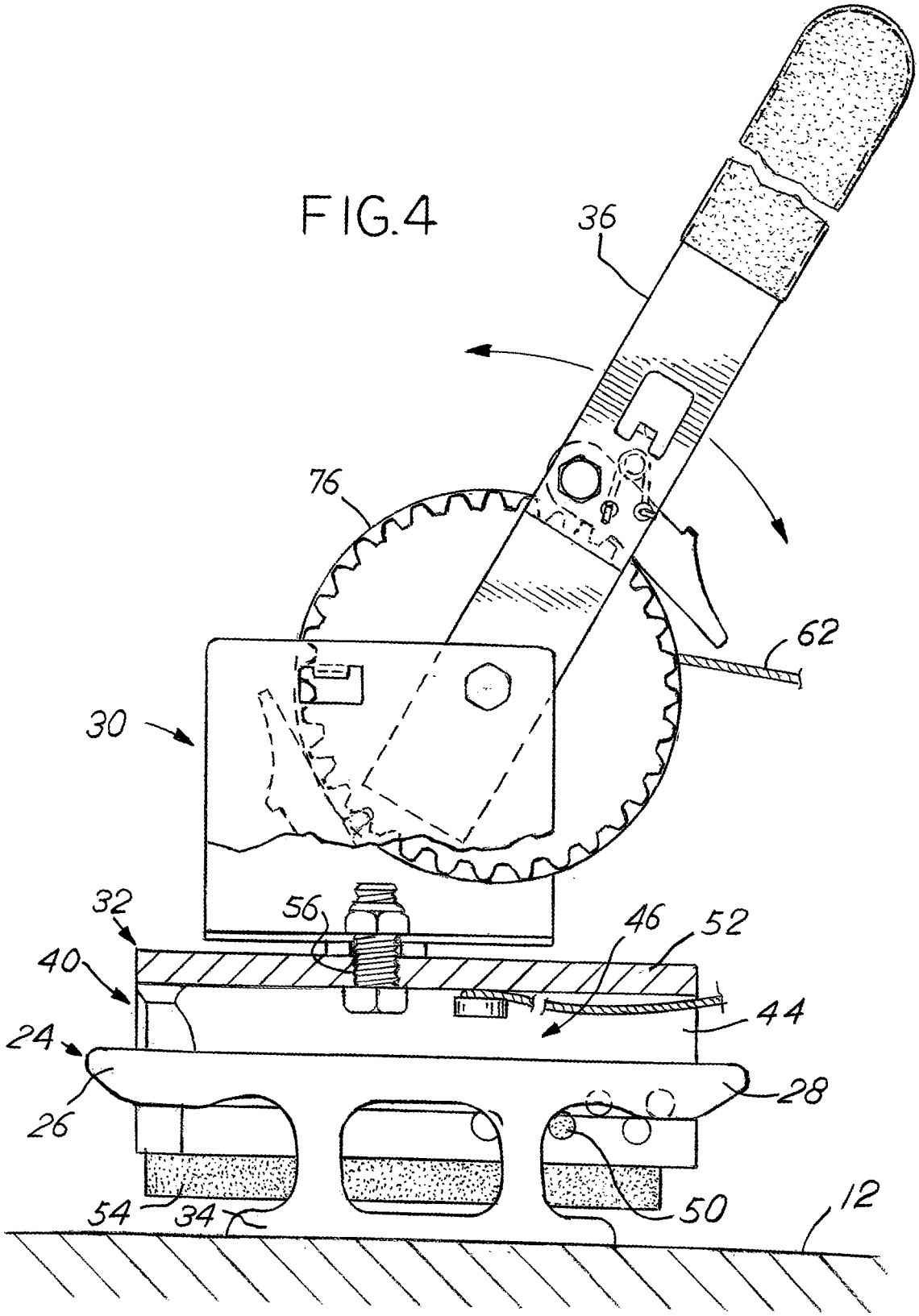
FIG. 4 is a side view of the winch and cleat adaptor as installed on a cleat.

A rescue system 10 is shown in FIG. 1 as attached to a boat 12 and an operator 14 pulling a person 16 to safety. The system 10 has a floatation and tether portion 20 that attaches to the boat 12 and a winch portion 22 that secures the person 16. The winch portion 22 attaches to a cleat 24, shown in FIG. 6.

The winch portion 22 has a retraction mechanism 30 and a cleat adaptor 32. The retraction mechanism is shown as a manually operated winch, but other devices are contemplated, such as electrically operated winch, hand crank, roller, ratchet, or other device that can pull on a cable, strap, or cord. The cleat adaptor 32 is designed to fit over and affix to various sizes of boat cleats 24. Because boat cleats 24 are used to tie a boat to a pier or dock, they are securely affixed to the boat 12, providing a convenient and secure point for the cleat adaptor 32. Cleats 24 have horns 26, 28 that are spaced from a mounting flange 34. The cleat adaptor 32 has a horn aperture 40 on one end that receives one of the horns 26. This is shown in FIG. 6. The cleat adaptor 32 has parallel walls 42, 44, with a cleat channel 46 located between them. On the walls 42, 44 located on an end opposite the horn aperture 40, are a series of locking holes 48. The locking holes 48 receive a pin 50 that extends across the cleat channel 46 to lock in the other horn 28. The pin 50 is tethered 51 to prevent it from being misplaced. The user 14 selects the closest locking hole 48 that holds the cleat 24 securely inside the cleat channel 46. The cleat adaptor 32 is shown with an optional padded bottom surface 54 to prevent marring, scratching, or other damage from the cleat adaptor 32 when affixed to the cleat 24.

The walls 42, 44 are connected at a top wall 52 that mounts the retraction mechanism 30 through a mounting aperture 56. The mounting aperture 56 allows the retraction mechanism 30 to swivel. Swiveling the retraction mechanism 30 with respect to the cleat adaptor 32 prevents binding. The retraction mechanism 30 uses a lever 36 that moves back and forth to retract, instead of a handle that rotates 360 degrees. When the winch portion 22 is affixed to a boat 12, there are frequently other components, such as railing, trim, or other components that would prevent a full rotation. By using the limited travel of the lever retraction mechanism 30, interference with the boat hull or other components is reduced or eliminated. It is contemplated that the retraction mechanism could be a hand crank or electric winch of some sort, provided no part would extend beyond the bottom, where it could interfere with the components on the boat 12.

Instead of the retraction mechanism 30, the cleat adaptor 32 can be used to attach an assortment of other devices. The top wall 52 can be used to affix other devices, such as a grill, flag poles, fishing pole holders, umbrella holder, or anything that would need to be attached to a boat with a cleat. It is contemplated that the features of the cleat adaptor 32 can be integrated into the aforementioned devices or components.

Figure 9:
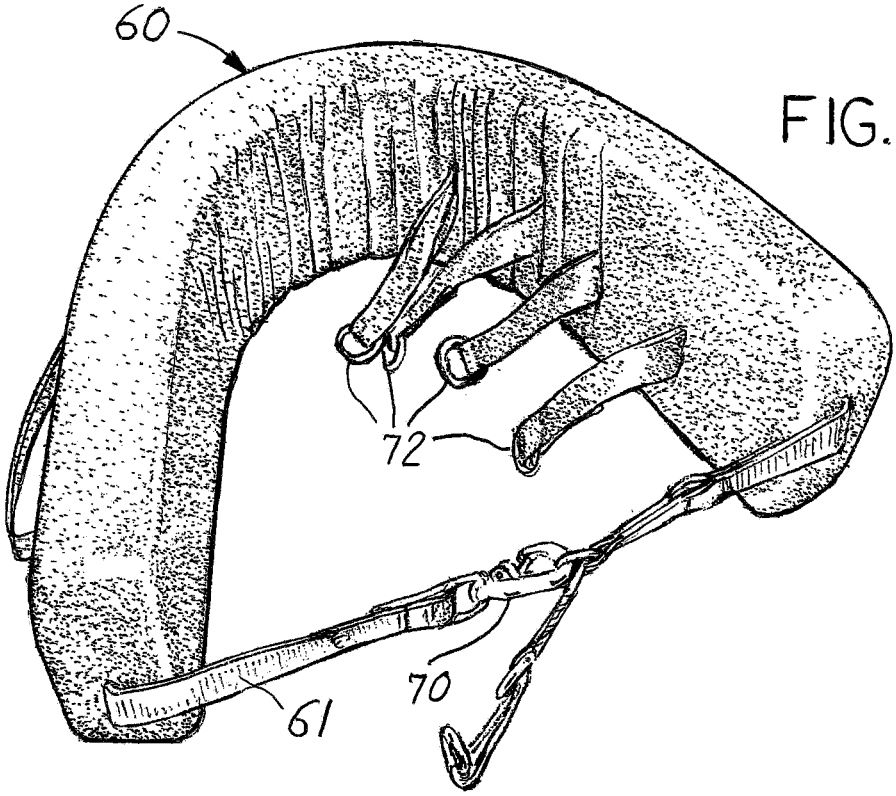
FIG. 9 is a perspective view of the floatation device in FIG. 1.
Figure 10:
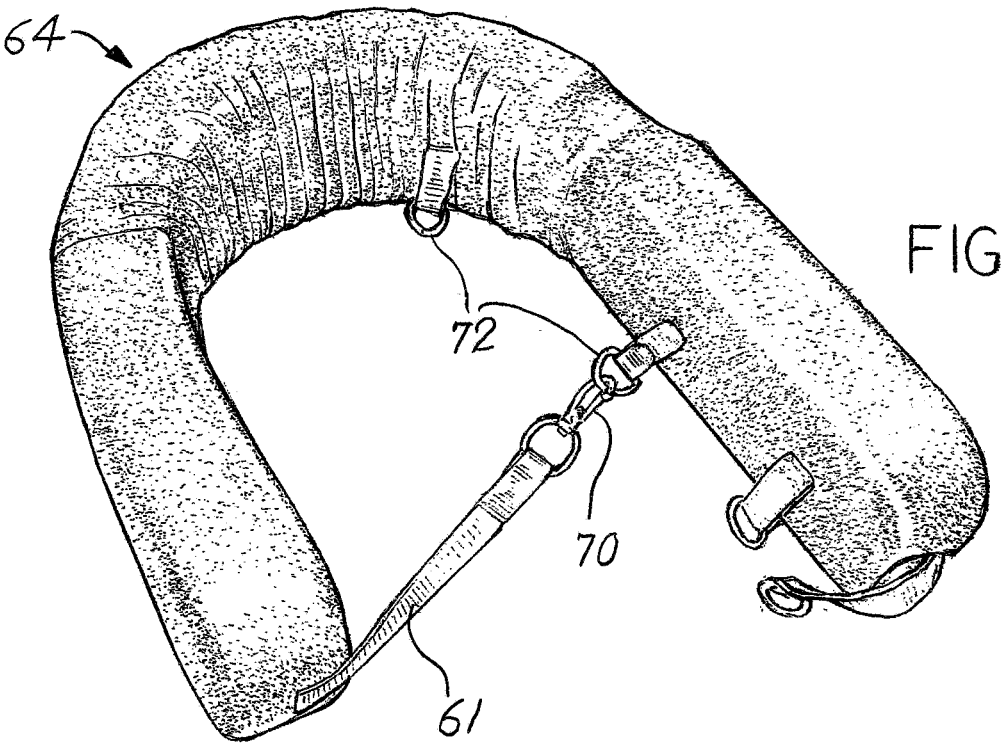
FIG. 10 is a perspective view of a smaller sized floatation device.

Turning now to the tether portion 20, there is a floatation end 60, 64 attached to a rope 62 or cable or is separable from the rope 62 with its own integral cable or rope 61. Floatation end 60 is larger and designed for adults. Floatation end 64 is smaller and can be used with children or pets. As shown in FIGS. 9 and 10, the rope or cable 61 may be separate from rope 62 to allow convenient storage and allow different devices to be attached. The flotation end 60, 64 is buoyant and can be in three connected segments or one flexible loop of buoyant material. Running through the floatation end 60, 64 is the rope 62 that terminates at a latch 70. The rope 62 is fixed or constrained inside the floatation end 60, 64. The latch 70 extends beyond the buoyant material enough for access by the user 14 or person 16. The latch 70 is designed to fit over the rope 62 to form a loop to surround the person 16. The flotation end 60, 64 may also contain a series of rings 72 or loops for the latch 70 to attach. The rings 72 are securely affixed to the segments and/or rope 62 to provide a secure attachment point.

To install the winch portion 22 with the cleat adaptor 32, the user takes the horn 26 of the cleat 24 and inserts it through the horn aperture 40. The installation shown in FIG. 6 shows the horn 26 partially inserted through the horn aperture 40. The user moves the horn 26 as far as possible through the horn aperture 40 and then locates the closest locking hole 48 that can receive the pin 50 underneath the other horn 28. This prevents the cleat adaptor 32 from becoming detached with movement. For the first time the user has installed the cleat adaptor 32, the user would mark the preferred locking hole 48 with a paint marker or other indelible marking device. This allows a quick and convenient reference for the next user. This is particularly important when someone has fallen into the water and needs to be retrieved. In this situation, time is of the essence and the user may not be thinking clearly. This could result in the user selecting the incorrect locking hole 48, which may leave the cleat adaptor 32 loose and become detached during use.

To deploy the tether portion 20, the user 14 would first thread the end of the rope 62 opposite the latch 70 through the drum 76 or otherwise attach it to the retraction mechanism 30. The user 14, or another operator, would then throw or swim the flotation end 60 of the tether portion 20 to the person 16. Depending on the size and ability of the person 16, the user 14 may connect the latch 70 to the rope 62 to form a "lasso." Pulling on the rope 62 would cause the latch 70 to slide down the rope 62 and tighten the flotation end 60 around the person. If the person 16 is smaller or has different abilities, the user may connect the latch 70 to one of the rings 72.

Figure 11:
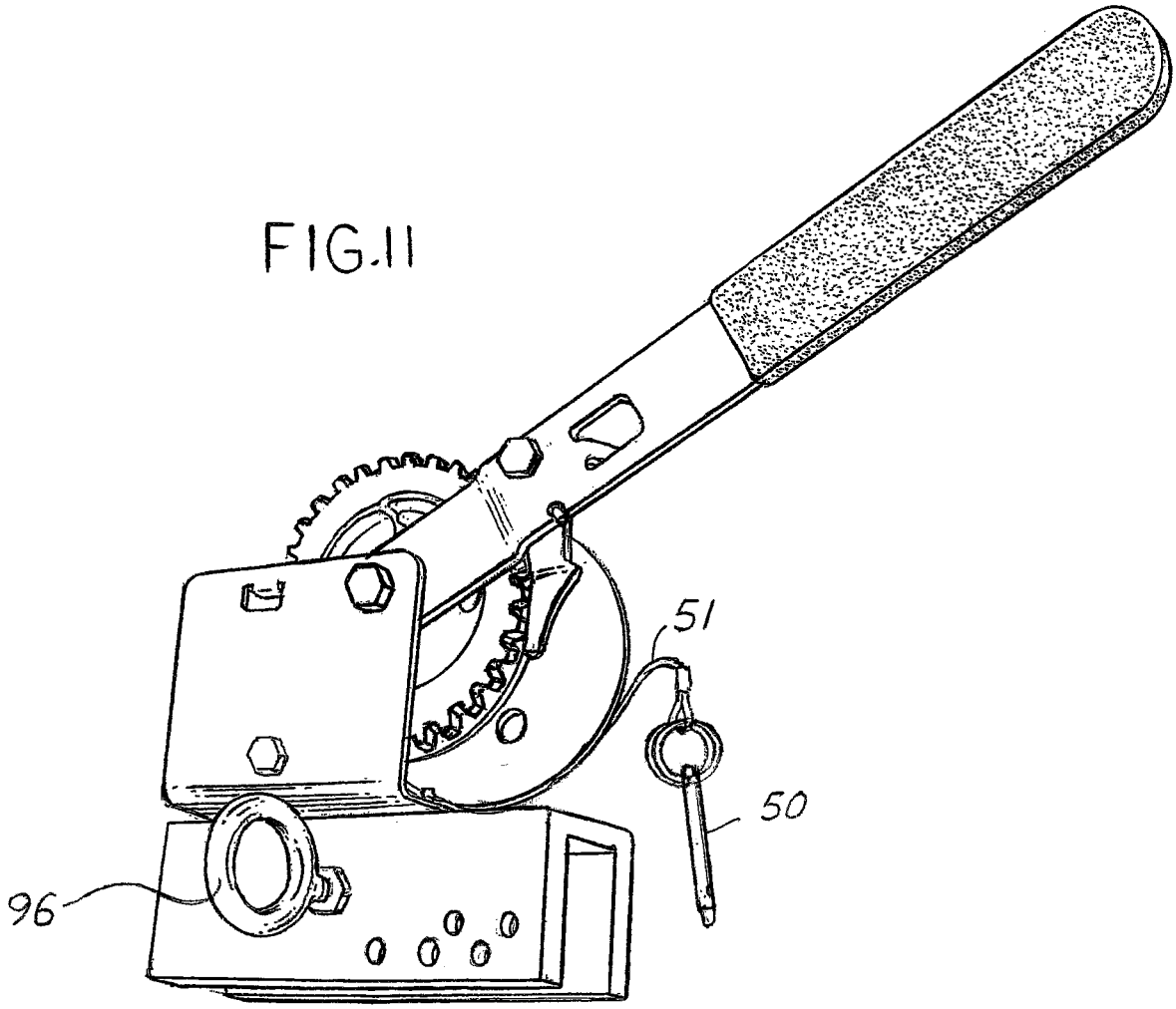
FIG. 11 is a perspective view of the winch, cleat adaptor, and ice adaptor.
Figure 11:
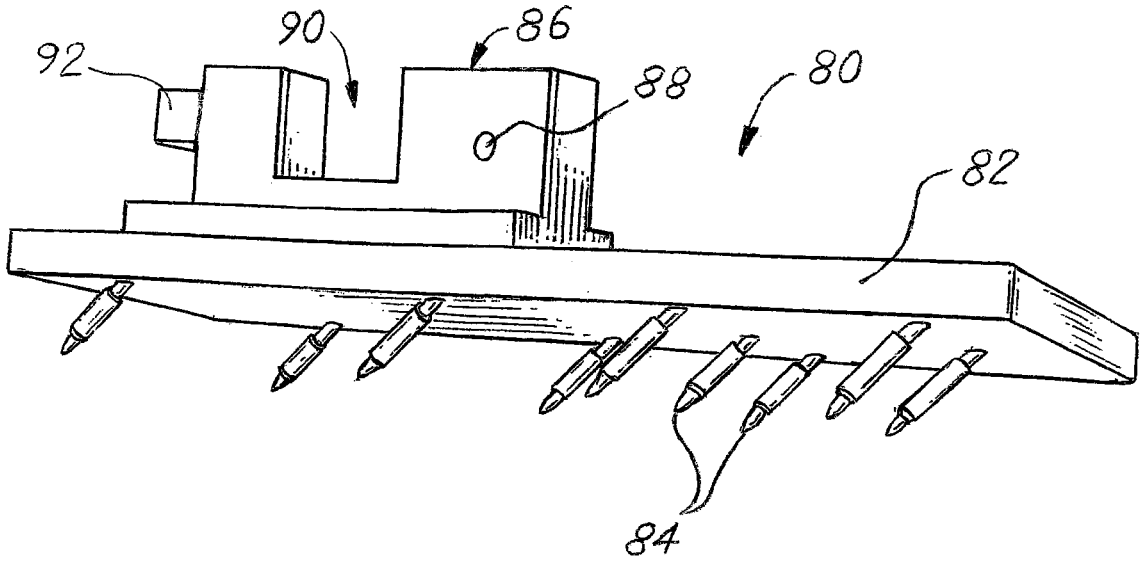

Other devices allow the tether and winch portions 20, 22 to be used on other things besides boat cleats. For example, an ice adapter 80 is shown in FIG. 11 that allows rescue of a stranded person who has fallen through thin ice. The ice adapter 80 has a foot portion 82 and a cleat portion 86. The cleat portion 86 is designed to mate to the cleat adapter 32 with a horn portion 92 being received by the horn aperture 40 with the remainder residing in the cleat channel 46. A locking hole 88 aligns with one of the locking holes 48 to receive the locking pin 50. The foot portion 82 has an array of cleats 84 that protrude at an angle that are pointed in a direction toward the horn portion. The oblique angle provides additional traction that pulls the ice adapter 80 further into the ice as the user attempts to pull a stranded person towards the retraction mechanism 30. In the event that no ice or boat cleat are available at the time a person needs rescue, eyelets 96 are shown on the sides of the cleat adapter 32 in FIG. 11. The eyelets 96 can be used to attach the cleat adapter 32 to a vehicle, tree, or other stationary object. The cleat portion 86 includes a clearance notch 90 for the inside features of the eyelets 96 and bolt that holds the retraction mechanism 30 to the cleat adapter 32.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A tethered floatation and a retrieval system for use with a cleat to retrieve an incapacitated person, said cleat having horns, said tethered floatation and retrieval system comprising:

a tether portion being a flexible rope separable to a flexible elongate floatation portion;

said flexible elongate floatation portion having a rope embedded therein and bonded thereto, said embedded rope extending out opposing ends of said flexible elongate floatation portion and terminating at a latch end on one end and a ring end on an opposite end, said flexible elongate floatation portion having a plurality of rings extending out through a side of said flexible elongate floatation portion and flexibly affixed to said embedded rope, said latch end of said embedded rope latchable to one of said rings to join portions of said flexible elongate floatation portion;

a winch portion rotatably affixed to a cleat adaptor, said cleat adaptor having parallel walls connected at a top wall to form a cleat channel, said cleat adaptor having a horn aperture for receiving one of said horns of said cleat, said parallel walls having a plurality of locking holes, said locking holes on one of said parallel walls aligned with said locking holes on an other side of said parallel walls to receive a pin, said winch portion having a drum to receive said tether portion of said flexible rope, said drum rotatable with a lever to wind said tether portion when said flexible rope is mated to said drum; and said winch portion securable to said cleat when one of said horns is received by said horn aperture and receives one of said horns is captured between said top wall and said pin.

2. The tethered floatation and retrieval system in claim 1, wherein said lever is only partially rotatable with respect to said drum, said lever remains clear of said cleat adaptor when said lever rotates said drum.

3. The tethered floatation and retrieval system in claim 1, further comprising an ice adapter, said ice adapter having a foot portion and a cleat portion, said foot portion having a plurality of cleats extending therefrom on one side at an oblique angle for being embedded in ice, said ice adapter affixed to said foot portion on a side opposite said plurality of cleats, said cleat portion having a horn portion to be received by said horn aperture and a locking hole to align with one of said locking holes on said parallel walls when said horn portion is received by said horn aperture.

4. The tethered floatation and retrieval system in claim 1, further comprising eyelets affixed to said parallel walls, said eyelets for affixing said winch portion to a stationary object.

5. The tethered floatation and retrieval system in claim 1, wherein said pin is tethered to said cleat adaptor.

6. The tethered floatation and retrieval system in claim 1, wherein said flexible rope is a strap.

7. A tethered floatation and a retrieval system for affixing to a cleat having horns, said tethered floatation and retrieval system comprising:

a tether portion having a flexible rope separable from an elongate flexible buoyant floatation portion, said elongate flexible buoyant floatation portion having a rope embedded therein and bonded thereto, said embedded rope extending out opposing ends of said buoyant floatation portion and terminating at a latch end on one end and a ring end on an opposite end, said elongate flexible buoyant floatation portion having a plurality of rings extending out through a side of said elongate flexible buoyant floatation portion and flexibly affixed to said embedded rope, said latch end of said embedded rope connectable to one of said rings to join portions of said elongate flexible buoyant floatation portion;

a winch portion attached to a cleat adaptor, said cleat adaptor having parallel walls forming a cleat channel, said cleat adaptor having a horn aperture, said cleat adaptor having apertures extending through said parallel walls to receive a pin, said winch portion for retracting said separable rope to pull said elongate flexible buoyant floatation portion toward said winch portion; and when said cleat is located in said cleat channel and one of said horns is located in said horn aperture, said pin is extendable through said apertures to constrain said cleat to said cleat adaptor when said pin extends underneath one of said horns.

8. The tethered floatation and retrieval system in claim 7, wherein said winch portion has a lever to rotate a drum, said lever is only partially rotatable with respect to said drum, said lever remains clear of said cleat adaptor.

9. The tethered floatation and retrieval system in claim 7, further comprising an ice adapter, said ice adapter having a foot portion and a cleat portion, said foot portion having a plurality of cleats extending therefrom on one side for being embedded in ice, said ice adapter affixed to said foot portion on a side opposite said plurality of cleats, said cleat portion having a horn portion to be received by said horn aperture and a locking hole to align with one of said locking holes on said parallel walls when said horn portion is received by said horn aperture.

10. The tethered floatation and retrieval system in claim 7, further comprising eyelets affixed to said parallel walls, said eyelets for affixing said winch portion to a stationary object.

11. The tethered floatation and retrieval system in claim 7, wherein said pin is tethered to said cleat adaptor.

12. The tethered floatation and retrieval system in claim 7, wherein said rope is a strap.

13. A method of retrieving an incapacitated person from a body of water using a retrieval system and a cleat having horns, said retrieval system having a tether portion being a flexible rope separable to a flexible elongate floatation portion, said flexible elongate floatation portion having a rope embedded therein and boned thereto, said embedded rope extending out opposing ends of said flexible elongate floatation portion and terminating at a latch end on one end and a ring end on an opposite end, said flexible elongate floatation portion having a plurality of rings extending out through a side of said flexible elongate floatation portion and flexibly affixed to said embedded rope, said latch end of said embedded rope connectable to one of said rings to join portions of said flexible elongate floatation portion, a winch portion rotatably affixedd to a cleat adaptor, said cleat adaptor having parallel walls connected at a top wall to form a cleat channel, said cleat adaptor having a horn aperture for receiving one of said horns of said cleat, said parallel walls having a plurality of locking holes, said locking holes on one of said parallel walls aligned with said locking holes on an other side of said parallel walls to receive a pin, said winch portion having a drum to receive said tether portion of said flexible rope, said drum rotatable with a lever to wind said tether portion, said method comprising:

securing said winch portion to said cleat by placing one of said horns in said horn aperture, locating another of said horns in said cleat channel, placing said pin in said locking holes to locate one of said horns between said top wall and said pin;

connecting said flexible elongate floatation portion to said flexible rope;

securing said floatation portion to said incapacitated person by connecting said latch to the flexible rope around said incapacitated person;

threading an opposite end of said flexible rope through said drum; and moving said lever back and forth and winding said flexible rope to pull said incapacitated person and said floatation portion toward said retrieval system.

14. The method of claim 13, wherein said cleat is attached to a watercraft.

15. The method of claim 13, wherein said cleat is affixed to an ice adapter, said ice adapter having a foot portion and a cleat portion, said foot portion having a plurality of cleats extending therefrom on one side at an oblique angle for being embedded in ice, said ice adapter affixed to said foot portion on a side opposite said plurality of cleats, said cleat portion having a horn portion to be received by said horn aperture and a locking hole to align with one of said locking holes on said parallel walls when said horn portion is received by said horn aperture, further comprising the step of securing said ice adapter to ice after securing said winch portion to said cleat portion.

16. The method of claim 13, further comprising eyelets affixed to said parallel walls, said eyelets for affixing said winch portion to a stationary object, further comprising the step of affixing said cleat adaptor to another object using said eyelets.

17. The method of claim 13, wherein said pin is tethered to said cleat adaptor.

* * * * *